US005544561A

United States Patent [19]

Isomi

[11] Patent Number: 5,544,561

[45] Date of Patent: Aug. 13, 1996

[54] INTERGRATED MOUNTING SYSTEM FOR DRUMS

[75] Inventor: Takenori Isomi, Nashville, Tenn.

[73] Assignee: Pearl Musical Instrument Company

[21] Appl. No.: 258,619

[22] Filed: Jun. 15, 1994

Related U.S. Application Data

[63] Continuation-in-part of Ser. No. 4,408, Jan. 14, 1994, abandoned.

[51] Int. Cl.[6] ..... G10D 13/02; G10G 5/00

[52] U.S. Cl. ..... 84/421; 224/910; 248/443

[58] Field of Search ..... 84/421, 453; 224/910; 248/443

[56] References Cited

U.S. PATENT DOCUMENTS

| | | | |
|---|---|---|---|
| 2,433,594 | 12/1947 | Calo | 84/421 |
| 2,588,830 | 3/1952 | Haanstad | 84/421 |
| 3,780,613 | 12/1973 | Ludwig, Jr. | 84/421 |
| 4,387,839 | 6/1983 | Drauchak | 84/421 |
| 4,519,289 | 5/1985 | Gauger | 84/421 |
| 4,596,176 | 6/1986 | Gauger | 84/421 |
| 4,903,570 | 2/1990 | Sassmannshausen et al. | 84/421 |

FOREIGN PATENT DOCUMENTS 2052827 1/1981 United Kingdom .

*Primary Examiner*—Cassandra C. Spyrou
*Attorney, Agent, or Firm*—Longacre & White

[57] ABSTRACT

The instant invention relates to a bracket for mounting drums of the snare and tom-tom type comprising a bracket for mounting drums of the tom-tom type consisting of a steel plate having a lip and adjustable hooks secured by screws that grasp the top and bottom of the pre-existing rim of the drum. Attached to the bottom of the bracket is a screw surrounded by shock absorbing material terminated with a rubber bumper to provide additional support of the bracket to the drum. A drum mounting attachment is attached to the bracket and not to the body of the drum. The bracket can be mounted to drums of different diameters with no modification to the bracket.

16 Claims, 3 Drawing Sheets

INTERGRATED MOUNTING SYSTEM FOR DRUMS

This is a continuation in part of application Ser. No. 08/004,408, filed Jan. 4, 1994; now abandoned.

BACKGROUND OF THE INVENTION a) Field of the Invention

The present invention pertains to a bracket for mounting drums, particularly of the tom-tom and snare types, consisting of a clamping member that grasp the top and bottom of the pre-existing rim of the drum. A shock absorbing material may be secured to a lower portion of the clamping member to provide additional support wherein the shock absorbing material rests against the drum shell without penetrating the drum shell. The support system, which facilitates easy and flexible attachment to various drum mounting arrangements, is secured to the drum rim by means of adjustable clamps.

b) Description of Related Art

Tom-tom and snare drums have generally been mounted for playing by one of two methods. First, a bracket is affixed to the bass drum and the other end of the bracket is mounted, usually by screws, to the middle of the shell of the tom-tom. This first method of mounting produces the undesirable result that vibration of the middle region of the shell of the drum is severely dampened due to the engagement of the relatively fixed support bearing the weight of the drum. Such dampening results in decreased loudness, tonal quality, and length of resonance. The second method of mounting the drums amounts to setting each drum on a separate stand similar to a snare drum stand and having three arms with upturned tips that cradle the drum. While this type of stand results in a desirable tonal quality, it has the disadvantage that the drums generally must be placed further from the drummer and require large amounts of space for positioning.

Previous alternative attempts for mounting drums are shown in U.S. Pat. Nos. 4,596,176, 3,780,613, 2,588,830 and 2,433,594. In U.S. Pat. Nos. 2,588,830 and 2,433,594, brackets are mounted to the drum lugs. There is, however, no provision for an easy clamping arrangement which is simply affixed to the rim of a drum and has a lower support member which rests on the drum shell as disclosed by the instant invention. Moreover, while U.S. Pat. No. 4,596,176 shows a means for clamping to a drum rim, the mounting arrangement of U.S. Pat. No. 4,596,176 induces undesirable stress in the drum body due to its semi-cylindrical support of the drum shell and is limited to drums of the tom-tom type only, as it fails to provide an additional support member resting against the drum shell. The arrangement taught by U.S. Pat. No. 4,596,176 further fails to teach the simplified clamping arrangement of the instant invention.

SUMMARY OF THE INVENTION

It is the object of the present invention to provide a system for mounting drums comprising a simplified mounting arrangement providing improved sound quality, ease of installation and an inexpensive mounting means for tom-tom and snare type drums.

It is further the object of the instant invention to provide a simplified clamping arrangement for easy installation which clamps to the pre-existing rim of a drum and may have a lower support member which rests against the drum shell to reduce undesirable stress in the drum body.

It is further the object of the instant invention to provide a system for mounting drums which may be utilized with pre-existing hardware so as to be adaptable to drums with virtually any diameter without modification to the bracket.

It is further the object of the instant invention to provide a system for mounting drums which provides a natural and unrestrained sound.

It is further the object of the instant invention to provide a system for mounting drums which may be inexpensively and expeditiously manufactured.

It is also the object of the present invention to provide a system for mounting drums which facilitates easy assembly and storage.

These advantages are provided by the instant invention wherein a bracket for mounting drums of the tom-tom type consists of a steel plate having a lip and adjustable hooks secured by screws that grasp the top and bottom of the pre-existing rim of the drum. Attached to the bottom of the bracket is a screw surrounded by shock absorbing material terminated with a rubber bumper to provide additional support of the bracket to the drum. A drum mounting attachment is attached to the bracket and not to the body of the drum. The bracket can be mounted to drums of different diameters with no modification to the bracket.

These and other objects and advantages of the instant invention will become readily apparent as the following description is read in conjunction with the accompanying drawings.

DETAILED DESCRIPTION OF THE PREFERRED EMBODIMENT

Figure 1:
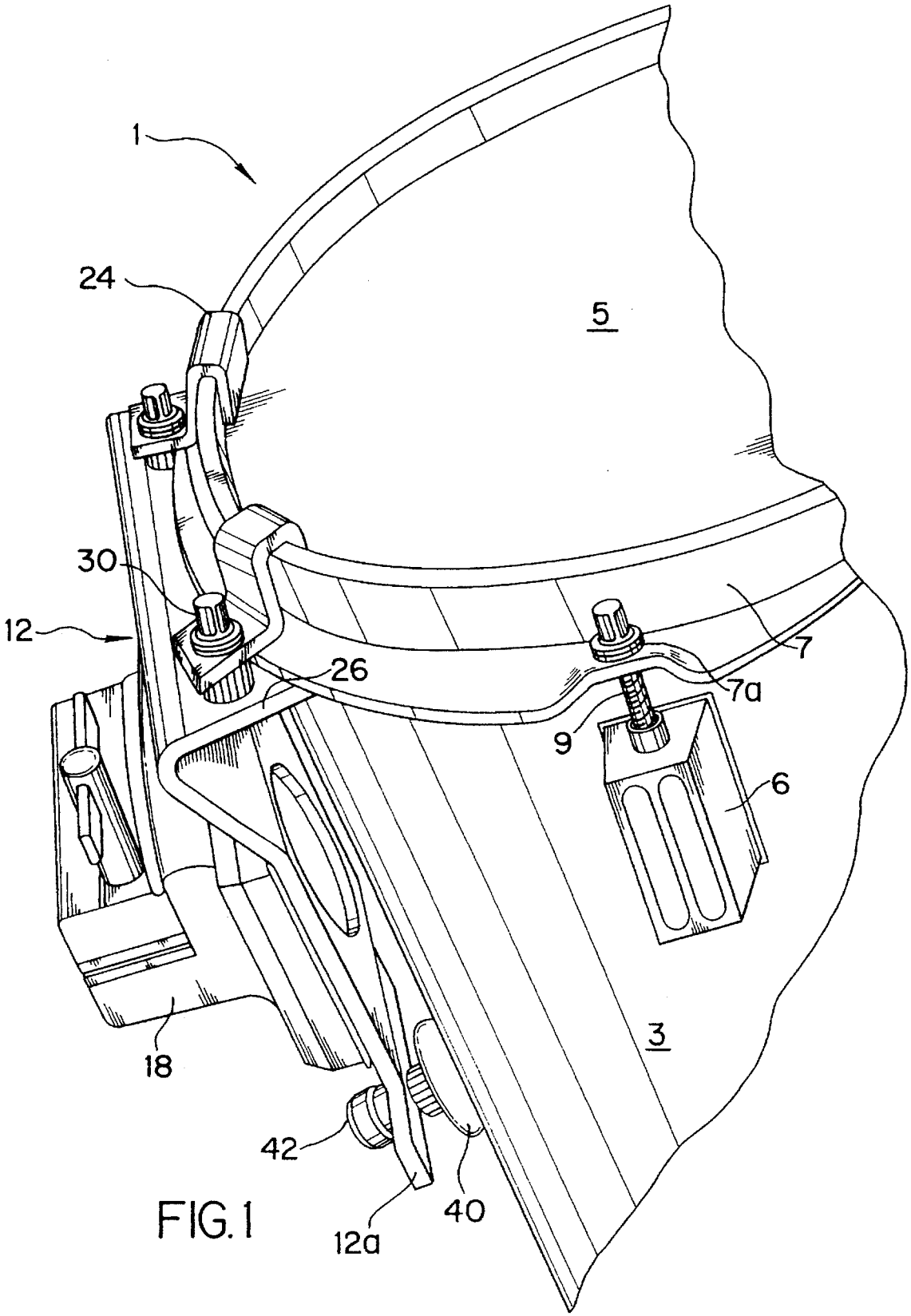
FIG. 1 is a perspective view of a first embodiment of the integrated mounting system of the instant invention.

With reference to FIG. 1, a drum 1 is partially shown comprising the mounting arrangement of the present invention. For a standard tom-tom or snare drum, a cylindrical shell 3 is provided having located at one or both ends thereof a plurality of castings 6. A drum head 5 is held in place by rim 7 which has a plurality of outwardly extending projections 7*a* having apertures located therein. A plurality of tension rods or lugs 9 are provided around the circumference of the drum and pass through the apertures in the rim and thread into the castings 6. These tension rods are tightened accordingly to tune the drum. The drum head is mounted conventionally between the rim and shell (not shown) and such mounting does not form the novel features of the present invention.

The drum mounting arrangement of the present invention comprises a bracket 12 having a flange member 12*a* which extends downwardly and substantially parallel to the drum shell 3. Provided on the flange 12*a* is connecting member 18 which serves to connect the mounting bracket 40 to a conventional fixed support, for example, a mounting arm 20 or other suitable support piece.

Provided on the bracket 12 are clamping members 24 and 26. The clamping members 24, 26 secure the bracket 12 to the rim 7 of the drum via bolt 30. Particularly, member 24 is formed as an S-shaped hook and fits over the top of the drum rim 7. Member 26, which is preferably formed so as to be integral with the bracket 12, is provided at the bottom of drum rim 7. The clamping members 26, 28 are secured to the rim 7 by bolt 30 which passes through the members 26, 28. Provided between the member 24 and 26 is a spacer 28, through which passes the bolt 30. The spacer 28 facilitates the secure clamping necessary to support the drum rim 7. In the preferred embodiment, clamping members 24 and 26 are provided at two location on the rim 7 as shown in FIG. 1. It should be understood that the present invention is not limited to the number or arrangement of the clamping members 24, 26 illustrated in FIGS. 1, but rather any suitable adjustable clamping or securing means may be provided to secure the bracket 40 to the ring 20.

To further reduce the transmission of vibration from the drum to the drum stand to which the bracket 12 is mounted, isolation members 27 may be provided between the clamping members 24, 26 and the drum rim 7. These isolation members may be in the form of rubber or any other suitable vibration absorbing material.

Figure 2:
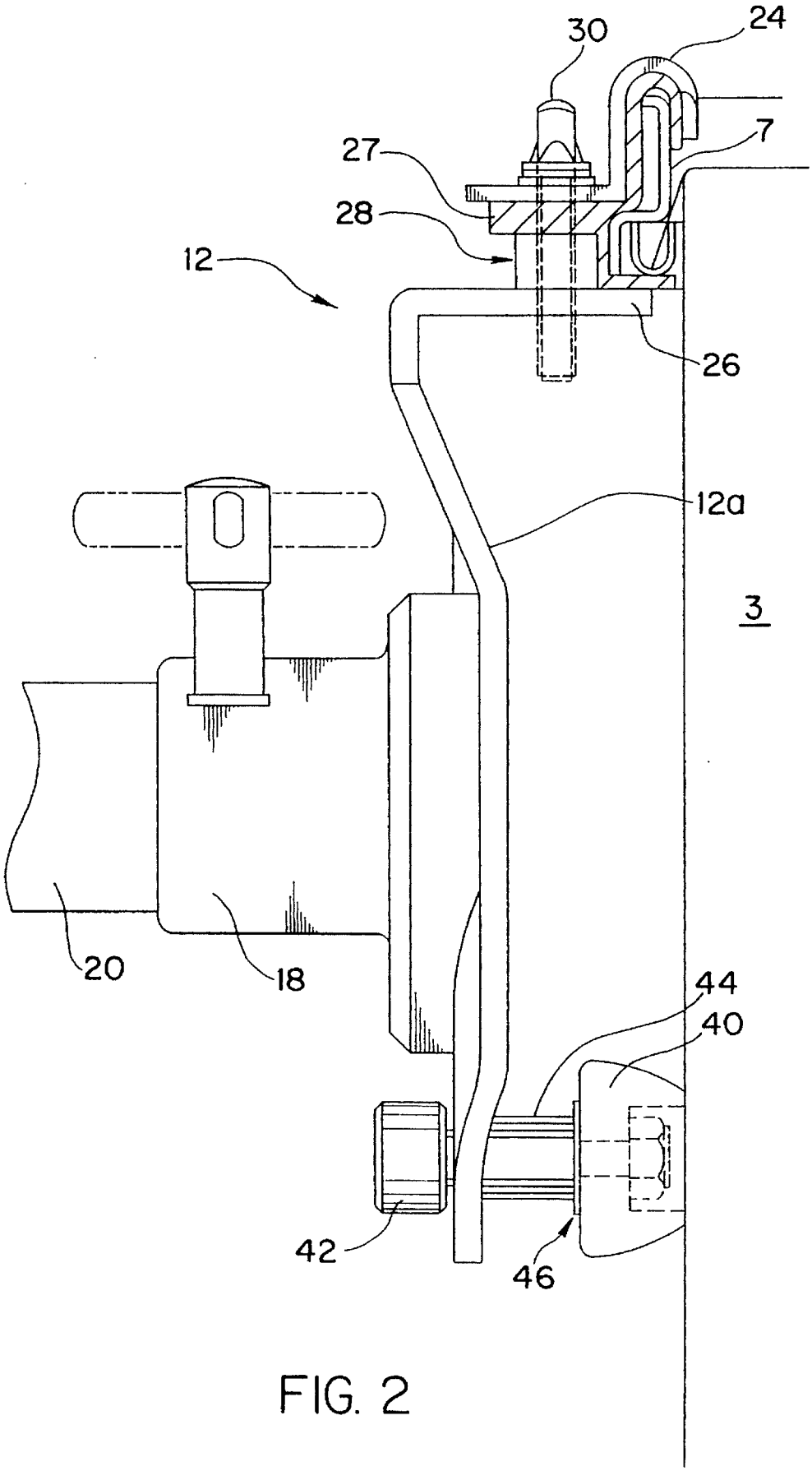
FIG. 2 is a side view of the integrated mounting system of the instant invention.

The integrated mounting system of the instant invention provides further support for the drum 1 by means of a resilient absorber 40, which is secured to the flange member 12*a* and rests against the drum shell 3 as shown in FIGS. 1 and 2. Specifically, at a distal or lower end of the flange 12*a* with respect to the clamping members 24, 26, additional support of the bracket 12 to the drum is provided by a screw 42. The screw 42 is surrounded by shock absorbing material in the form of a vinyl tube 44, a washer 46, and terminating with a resilient, rubber absorber 40. The screw 42 and rubber absorber 40 do not penetrate the drum shell to provide support. Instead, the rubber absorber 40 rests against the drum shell 3 to ensure a natural and unrestrained sound. Moreover, the additional support provided at the lower end of the flange 12*a* serves to reduce any undesirable stress induced in the drum rim 7 by the clamping members 24 and 26.

The vinyl tube 44 and washer 46, positioned between the absorber 40 and the flange 12*a*, serve both as vibration absorbers and spacers to hold the flange 12*a* at a distance from the shell 3. Thus, any detriment effect on the sound quality, resulting from contact between the flange 12*a* and the drum shell 3 is prevented.

Figure 3:
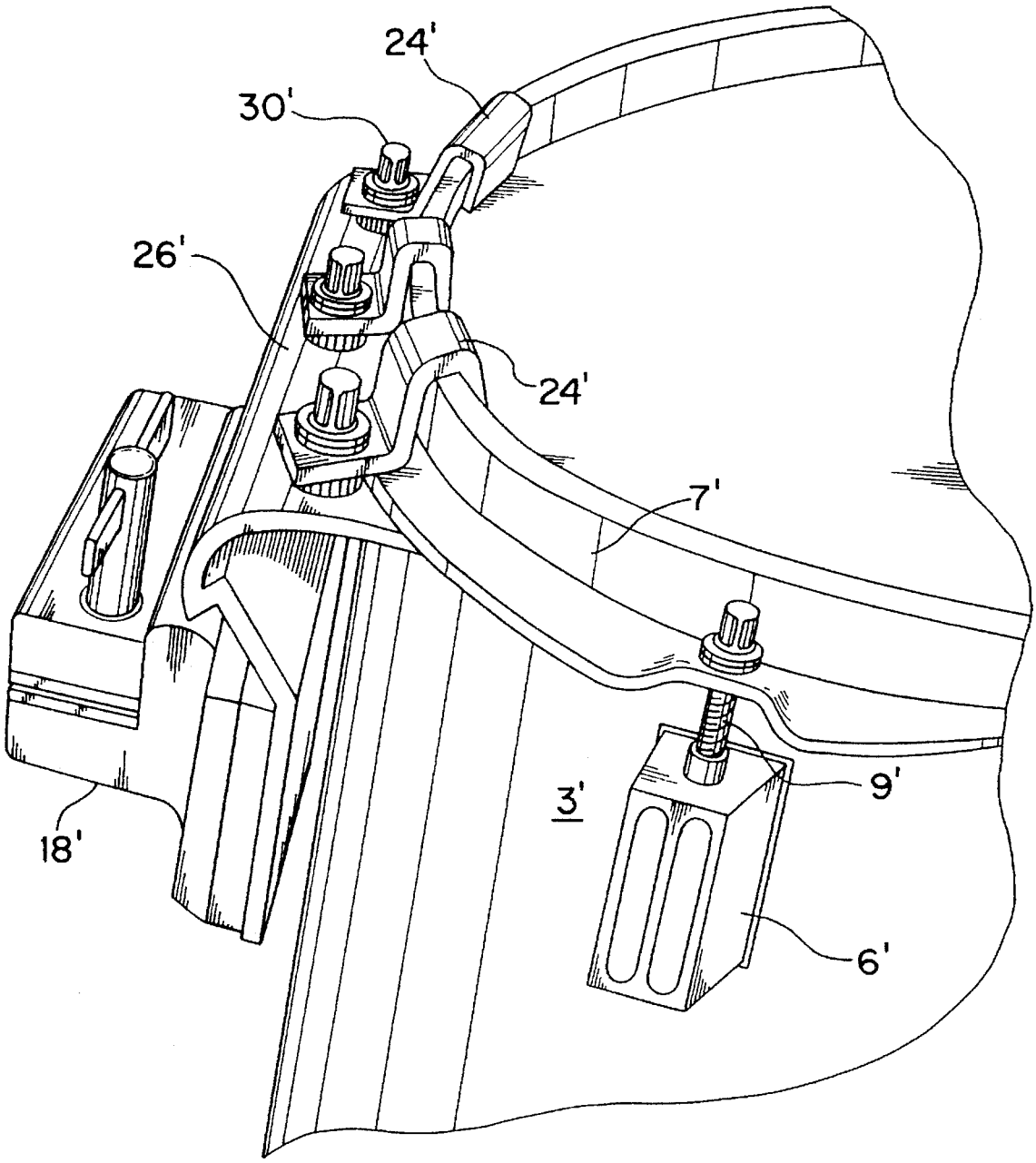
FIG. 3 is a perspective view of a second embodiment of the integrated mounting system of the invention.

FIG. 3 illustrates an arrangement without the lower support member or resilient absorber 40. The bracket 12' is simply clamped to the drum rim 7' by the first and second clamping members 24', 26'. As with the embodiment of FIGS. 1 and 2, a plurality of tension rods or lugs 9' are provided around the circumference of the shell 3' and pass through apertures in the rim 7' and thread into castings 6'. Bolts 30' secure the clamping members 24', 26' of the mounting bracket to the rim 7' with a variable clamping force, and the mounting bracket 12' is provided with a connecting member 18' to connect the mounting bracket to a conventional support. While the invention has been particularly shown and described with reference to a preferred embodiment, it will be understood by those having ordinary skill in the art that various changes in form and detail may be made therein without departing from the spirit and scope of the invention.

We claim:

1. A mounting system for a drum having a cylindrical shell, a drum head, a drum rim, and tuning means for adjusting a tune of said drum head, said tuning means passing through said drum rim, said mounting system comprising:

a drum mounting bracket means for adjustably securing said drum to a fixed support, said bracket means comprising a first end and a second end distal to said first end;

affixing means for securing said bracket means to said drum rim at various locations about a circumference of said drum, said affixing means located at said first end; and lower support means for supporting said drum, said lower support means secured to said second end of said bracket means and comprising a resilient member resting against said drum shell.

2. The mounting system recited in claim 1, wherein said affixing means comprises at least one first clamping member, a second clamping member, and a tightening means for adjusting a relative distance between said first and second clamping members to secure said first and second clamping members to said drum rim.

3. The mounting system recited in claim 1, wherein said lower support means further comprises a securing means for securing said resilient member to said second end.

4. The mounting system recited in claim 2, wherein said affixing means further comprises a rim vibration-absorbing means for minimizing the transfer of vibration from the drum rim to the fixed support.

5. The mounting system recited in claim 2, wherein said affixing means further comprises a spacing means provided between said first clamping member and said second clamping member for facilitating the securing of said bracket means to said rim.

6. The mounting system recited in claim 4 wherein said lower support means further comprises a spacing means provided between said second end and said rim vibration-absorbing means for providing a clearance between said bracket means to said drum shell.

7. The mounting system recited in claim 1, further comprising attachment means provided on said bracket means for adjustably attaching said bracket means to said fixed support.

8. A mounting system for a drum having a cylindrical shell, a drum rim, and tuning means disposed about a circumference of said drum for adjusting a tune of said drum head, said tuning means comprising tuning pegs which pass through said drum rim, said a drum mounting bracket means for adjustably securing said drum to a fixed support;

affixing means secured to said bracket means for clamping said bracket means to said drum rim, said affixing means adapted to adjustably contact said rim for positioning at various locations about said rim, wherein said-affixing means comprises at least one first clamping member, a second clamping member, and a tightening means for adjusting a relative distance between said first and second clamping members to clamp said first and second clamping members to said drum rim.

9. The mounting system recited in claim 8, wherein said affixing means is adapted to be positioned between two adjacent tuning pegs of said tuning means.

10. The mounting system recited in claim 8, wherein said affixing means comprises a rim vibration-absorbing means for minimizing the transfer of vibration from the drum rim to the fixed support.

11. The mounting system recited in claim 8, wherein said affixing means further comprises a spacing means provided between said at least one first clamping member and said second clamping member for facilitating the securing of said bracket means to said rim.

12. The mounting system recited in claim 8, further comprising attachment means provided on said bracket means for adjustably attaching said bracket to said fixed support.

13. A drum assembly comprising:

a drum comprising a cylindrical shell, a drum rim defining a circumference and a drum head;

fixed support means for supporting said drum; and a mounting system for adjustably securing said drum to said fixed support means, said mounting system comprising:

a drum mounting bracket means for securing said drum rim to said fixed support;

affixing means secured to said bracket means for affixing said bracket means to said drum rim, wherein said affixing means comprises at least one first clamping member, a second clamping member disposed opposite said first clamping member with respect to said drum rim such that a portion of said rim is disposed between said first and second clamping members, and a tightening means for adjusting a relative distance between said first and second clamping members to clamp said first and second clamping members to said drum rim.

14. The mounting system recited in claim 13, where said affixing means comprises a plurality of first clamping members, wherein each of said plurality of first clamping members are mounted to said second clamping member.

15. The mounting system recited in claim 13, wherein said second clamping member is formed as a straight engagement member disposed along a tangent to said drum rim circumference.

16. The mounting system recited in claim 13, wherein at least one of said first and second clamping members is integrally formed as part of said drum mounting bracket means.

* * * * *